US011730220B2

(12) United States Patent
Reek et al.

(10) Patent No.: US 11,730,220 B2
(45) Date of Patent: Aug. 22, 2023

(54) BALLOON HEADDRESS

(71) Applicants: Barrett Reek, Mercer Island, WA (US); Connie Reek, Mercer Island, WA (US)

(72) Inventors: Barrett Reek, Mercer Island, WA (US); Connie Reek, Mercer Island, WA (US)

( * ) Notice: Subject to any disclaimer, the term of this patent is extended or adjusted under 35 U.S.C. 154(b) by 0 days.

(21) Appl. No.: 17/874,601

(22) Filed: Jul. 27, 2022

(65) Prior Publication Data

US 2023/0056199 A1 Feb. 23, 2023

Related U.S. Application Data

(63) Continuation of application No. 17/407,929, filed on Aug. 20, 2021, now Pat. No. 11,425,949.

(51) Int. Cl.

| | |
|---|---|
| ***A42B 1/24*** | (2021.01) |
| ***A42B 1/004*** | (2021.01) |
| ***A42B 1/203*** | (2021.01) |

(52) U.S. Cl.

CPC ..... *A42B 1/24* (2013.01); *A42B 1/004* (2013.01); *A42B 1/203* (2013.01)

(58) Field of Classification Search

CPC ..... A42B 1/004; A42B 1/006; A42B 1/205; A42B 1/206; A42B 1/24; A42B 1/248; A42B 1/203; A42B 1/242; A42B 1/244; A42B 3/0406; A45B 11/04; A45D 8/006; A45D 8/36; A45D 8/004; A45D 8/40; A63H 2027/1008; A63H 2027/1041; A63H 27/10; A41D 20/00; Y10S 2/11

USPC ..... 2/DIG. 11; 224/181; D2/871, 875; D28/41; 132/54, 274, 275

See application file for complete search history.

(56) References Cited

U.S. PATENT DOCUMENTS

| | | | | | |
|---|---|---|---|---|---|
| D70,296 | S | * | 6/1926 | Skaruda | A63H 37/00 D28/41 |
| 2,840,948 | A | * | 7/1958 | Stickley | A63H 27/10 482/90 |
| 3,009,162 | A | * | 11/1961 | Hori | A42B 1/004 2/209.13 |

(Continued)

FOREIGN PATENT DOCUMENTS

| | | | |
|---|---|---|---|
| CN | 208711017 U | * | 4/2019 |
| GB | 252296 A | * | 5/1926 |

(Continued)

*Primary Examiner* — Amy Vanatta

(74) *Attorney, Agent, or Firm* — Skaar Ulbrich Macari, P.A.

(57) ABSTRACT

A balloon headdress, having a structure sized to fit a human head. Also, a plurality of engagement units is supported on the outside of the structure and a number of balloon retaining units, are engaged to the engagement units and adapted to receive, support and direct an inflated balloon to extend in a predetermined direction relative to each the balloon retaining unit. Each the balloon retaining unit includes a perimeter wall and a orthogonal septal wall, forming an upper cup and opposed lower cup, separated by the orthogonal septal wall, and wherein a vertical slot is defined in the perimeter wall and the orthogonal septal wall, whereby a tied balloon may be introduced, so that its knot is in the lower cup and a portion of balloon passes through the slot in the orthogonal septal wall and is supported in the upper cup.

16 Claims, 5 Drawing Sheets

(56) References Cited

U.S. PATENT DOCUMENTS 4,428,149 A * 1/1984 Brown ..... A63H 27/10 446/222
4,715,841 A * 12/1987 Nelson ..... A63H 27/10 446/222
4,798,554 A * 1/1989 Nelson ..... A63H 27/10 446/222
4,881,916 A * 11/1989 Houser ..... A63H 27/10 446/222
4,895,545 A * 1/1990 Nelson ..... A63H 27/10 446/222
5,027,992 A * 7/1991 Murray, III ..... G09F 21/02 D2/869
D336,543 S * 6/1993 Murray, III ..... D2/871
5,395,276 A * 3/1995 Valentino ..... A63H 33/40 446/222
5,829,457 A * 11/1998 Huang ..... A45C 13/08 63/3
6,024,102 A * 2/2000 Huang ..... A45D 8/36 132/273
6,047,709 A * 4/2000 Tu ..... A45D 8/36 132/273
6,289,903 B1 * 9/2001 Haufler ..... A01K 27/006 63/23
6,513,167 B1 * 2/2003 Cheng ..... A45D 8/36 2/209.13
D537,984 S * 3/2007 Steudle ..... A63H 27/10 D28/41
D628,659 S * 12/2010 Burns ..... A42B 1/004 D21/453
10,561,217 B1 * 2/2020 Wang ..... F21V 23/001
2008/0202548 A1 * 8/2008 Fala ..... A45D 8/36 132/273
2015/0360140 A1 * 12/2015 Hillery ..... A63H 37/00 446/475
2017/0319976 A1 * 11/2017 Nelson ..... A63H 27/10

FOREIGN PATENT DOCUMENTS

KR 20090006663 U * 7/2009
KR 20150083603 A * 7/2015

* cited by examiner

BALLOON HEADDRESS

RELATED APPLICATIONS

This application is a continuation of U.S. Ser. No. 17/407,929, filed Aug. 20, 2021, which is incorporated by reference as if fully set forth herein.

BACKGROUND OF THE INVENTION

Balloons have been used to create engaging headgear, by tying a balloon or set of balloons into a shape that easily fits on a human head. But doing this requires some skill and training. Festooning a person's head, with a colorful assortment of balloons would add an element of festivity to any celebratory gathering, particularly a child's celebration.

SUMMARY OF INVENTION

The following embodiments and aspects thereof are described and illustrated in conjunction with systems, tools, and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a balloon headdress, having a structure sized to fit a human head. Also, a plurality of engagement units is supported on the outside of the structure and a number of balloon retaining units, are engaged to the engagement units and adapted to receive, support and direct an inflated balloon to extend in a predetermined direction relative to each the balloon retaining unit. Each the balloon retaining unit includes a perimeter wall and a orthogonal septal wall, forming an upper cup and opposed lower cup, separated by the orthogonal septal wall, and wherein a vertical slot is defined in the perimeter wall and the orthogonal septal wall, whereby a tied balloon may be introduced, so that its knot is in the lower cup and a portion of balloon passes through the slot in the orthogonal septal wall and is supported in the upper cup.

In a second separate aspect, the present invention may take the form of a method of creating a balloon-festooned headdress that utilizes a display headdress that has a structure sized and shaped to fit on a human head, the structure defining an inside, facing the head when worn, and an outside, opposed to the inside. A plurality of engagement units is supported on the outside of the structure. Also, a number of balloon retaining units are engaged to the engagement units and adapted to receive, support and direct an inflated balloon to extend in a predetermined direction relative to each the balloon retaining unit. Each balloon retaining unit includes a perimeter wall and a orthogonal septal wall, forming an upper cup and opposed lower cup, separated by the orthogonal septal wall, and wherein a vertical slot is defined in the perimeter wall and the orthogonal septal wall, whereby a tied balloon may be introduced, so that its knot is in the lower cup and a portion of balloon passes through the slot in the orthogonal septal wall and is supported in the upper cup. In the method, a balloon is inflated, and its open end is tied to form a knot. A balloon retaining unit is disengaged from an engagement unit and engaging the balloon to the balloon retaining unit by passing a portion through the vertical slot, so the knot is in the lower cup and the balloon extends out of the upper cup and reengaging the balloon retaining unit is reengaged to the engagement unit. These method steps are repeated for additional balloons.

In a third separate aspect, the present invention may take the form of a display headdress, including a polymeric structure sized and shaped to fit on a human head, the structure defining an inside, facing the head when worn, and an outside, opposed to the inside. Also, six or more engagement units are supported on the outside of the polymeric structure and six or more display units are attached to the engagement units.

BRIEF DESCRIPTION OF DRAWINGS

Various embodiments of the invention are disclosed in the following detailed description and accompanying drawings.

DETAILED DESCRIPTION AND EMBODIMENTS

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

To assist the description of the scope and its components the coordinate terms "inside" and "outside" are used to describe the disclosed embodiments. The terms are used consistently with the description of the exemplary applications and are in reference to the head of a user. With respect to the headdress, the "inside" faces the head when worn, and the outside faces away from the head, when the headdress is worn as intended.

Figure 1:
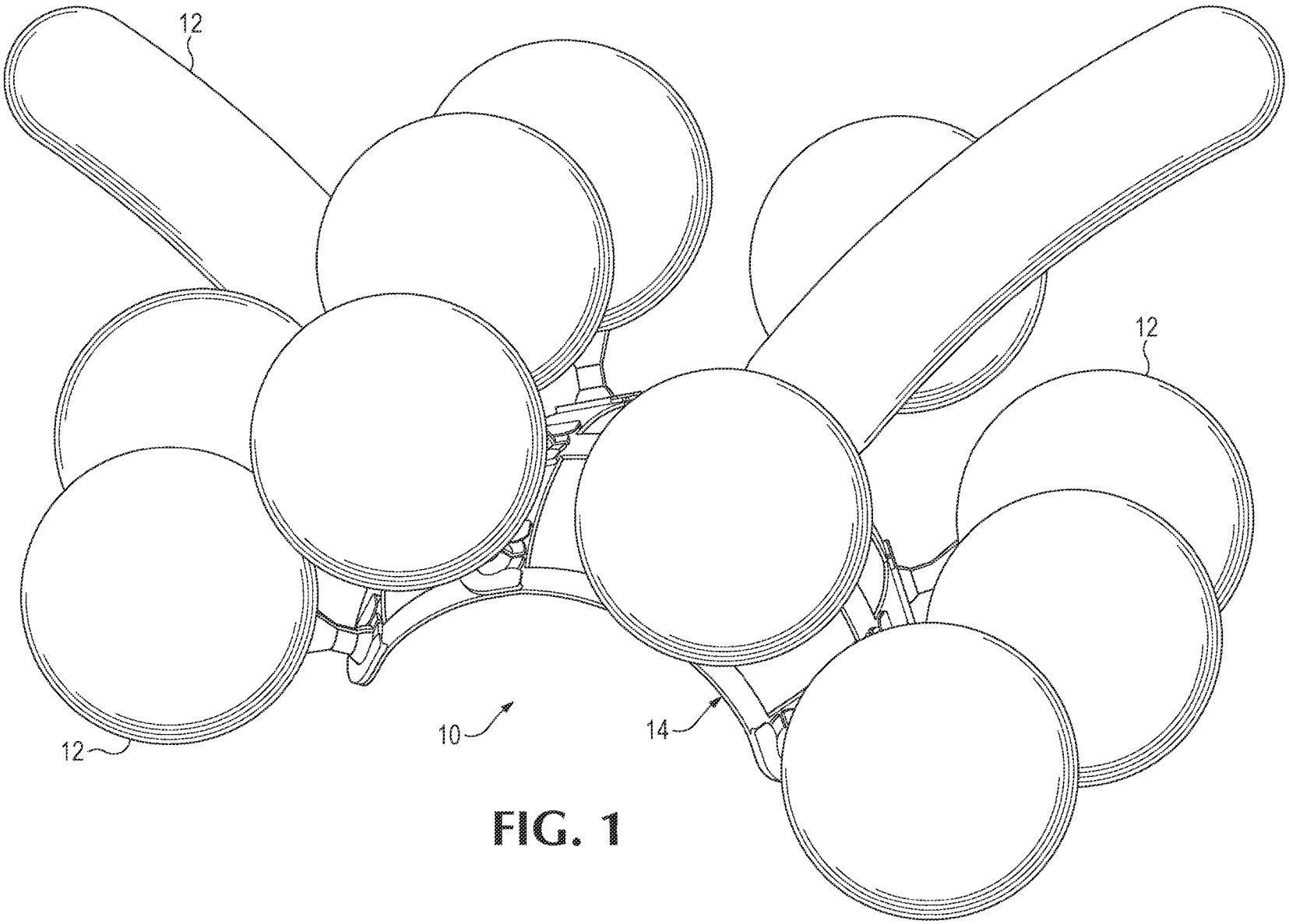
FIG. 1 is an isometric view of an article of balloon headdress, festooned with inflated balloons.
Figure 2:
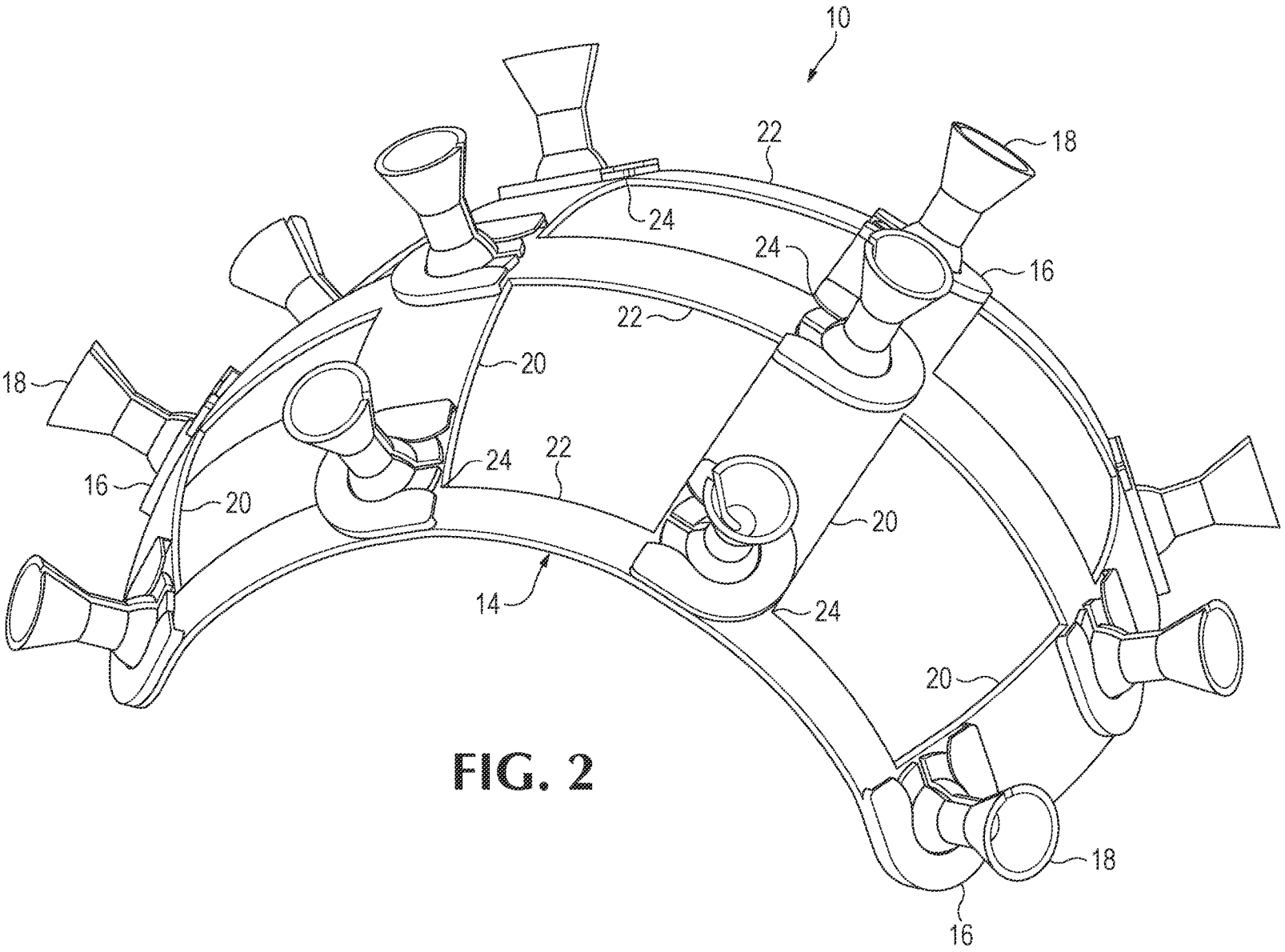
FIG. 2 is an isometric view of the headdress of FIG. 1, absent the balloons.

Referring to FIG. 1, a headdress 10 is shown having twelve inflated balloons 12 attached to it. Although the balloons are shown as being uniformly spheroidal in shape, in other instances of use, the balloons may be various shapes, creating a spectacular assemblage of differently colored shapes abutting one another. FIG. 2 shows headdress 10, having a structure 14, supporting on its outside a set of engagement units 16 and a set of balloon retaining units 18, each adapted to fit into an engagement unit 16. Structure 14 is a lattice of strips 20 and a cross-strips 22 hosting engagement units 16 at the intersections 24.

Figure 4:
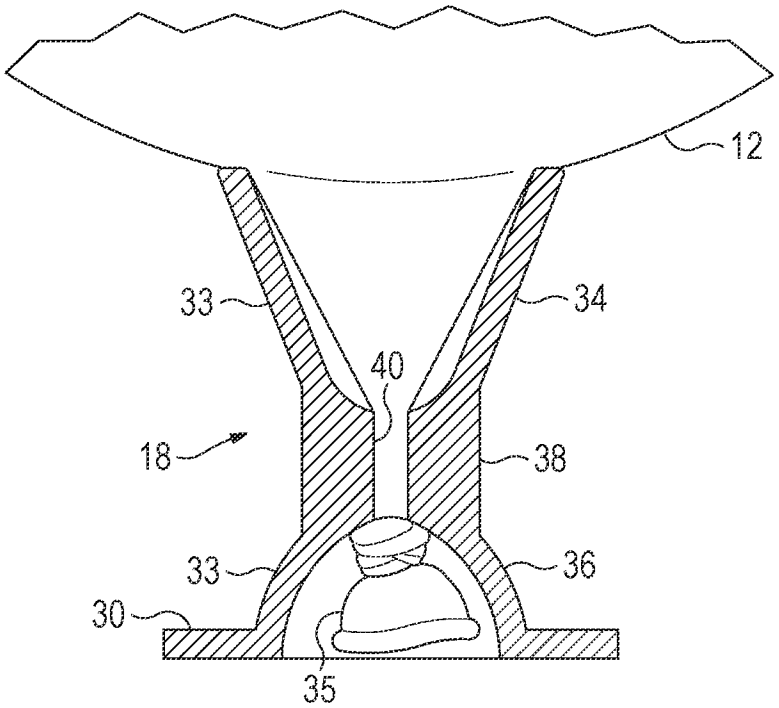
FIG. 4 is a sectional view of a balloon retaining unit, retaining an inflated balloon.
Figure 3:
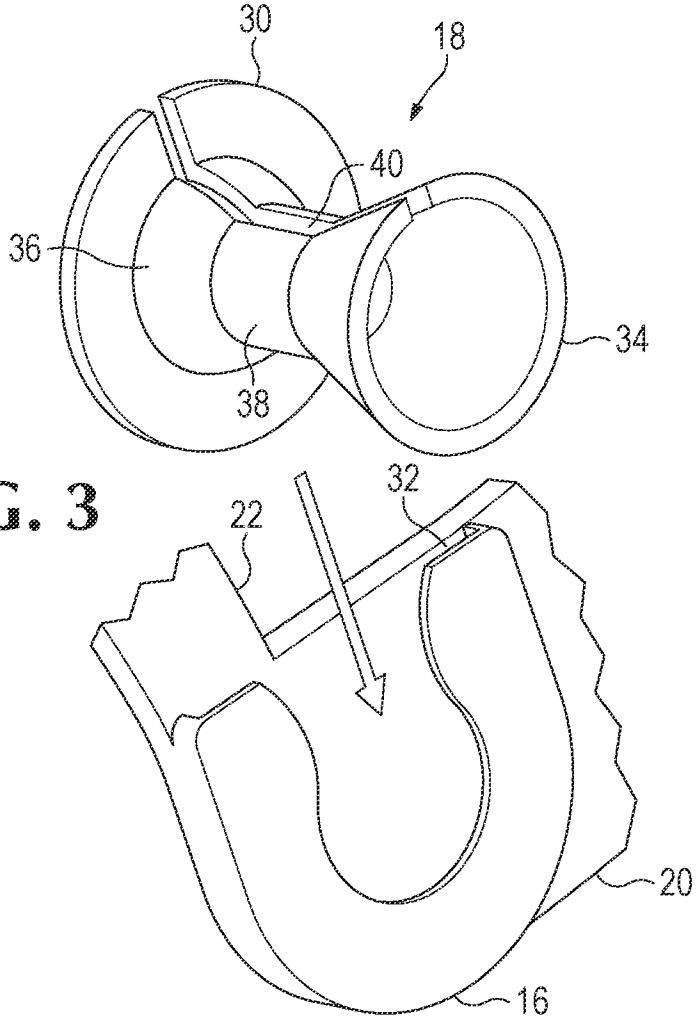
FIG. 3 is an isometric view of a balloon retaining unit, and an engagement unit.

Referring to FIGS. 3 and 4, an engagement unit 16 and a retaining unit 18, join together by a sliding motion as indicated by the arrow, whereby a retaining unit flange 30 is engaged with an engaging unit slot 32. Retaining unit 18, further includes a perimeter wall 33 and an orthogonal septal wall 38, together forming an upper cup 34 and an opposed lower cup 36. Walls 33 and 38 and, hence, cups 34 and 36 are cleft by a slot 40. A user may easily inflate a balloon 12, tie the end, slip the tied end 35 of the balloon through the slot so that the knot is in the lower cup 36, separated from the remainder of the balloon 12 by the septal wall 38 (and thereby retained). The upper cup 34, due in part to its expanding inner diameter, supports the balloon so that it will tend to extend outwardly in the specific direction in which upper cup 34 is pointing.

Figure 5:
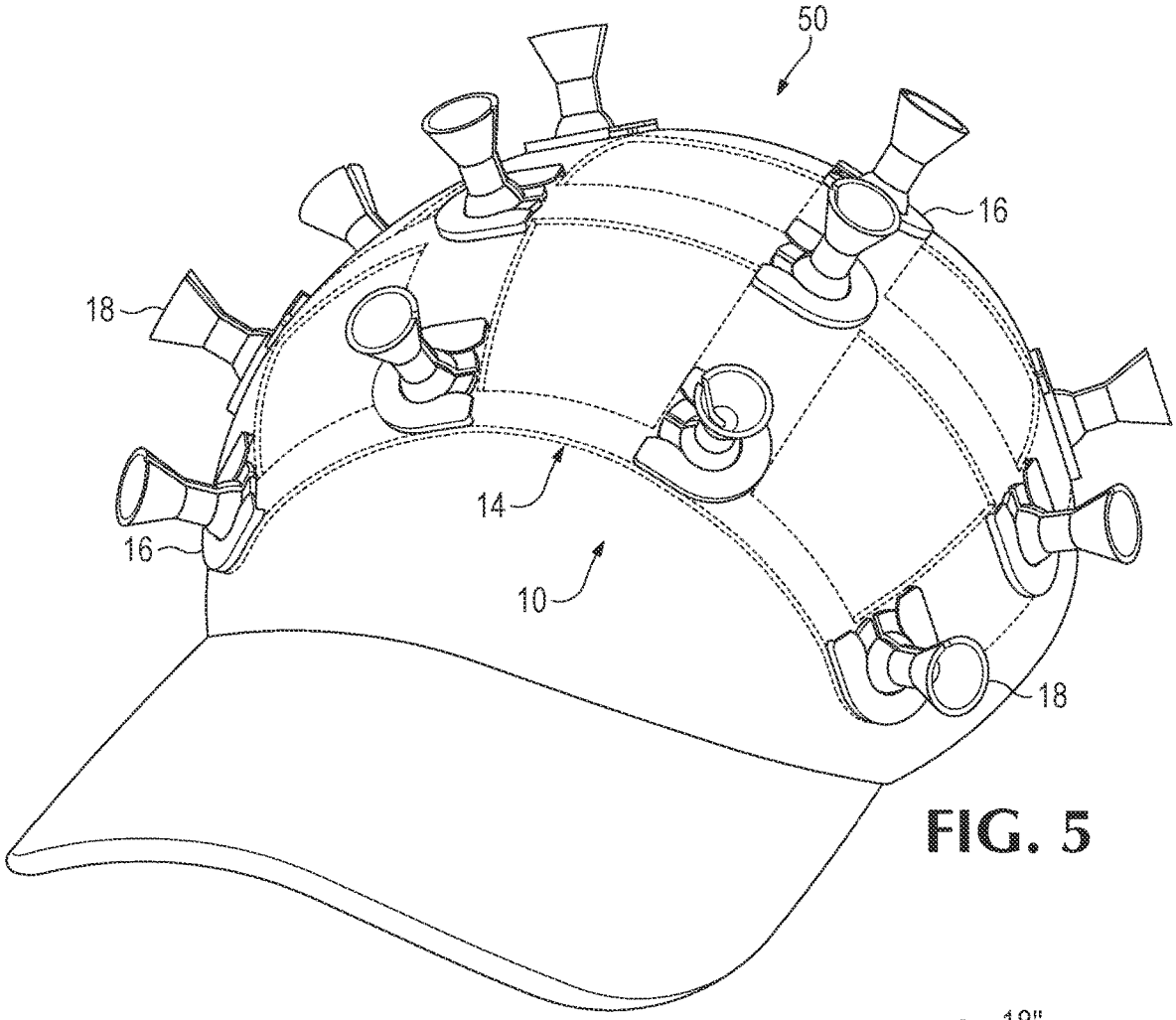
FIG. 5 is an isometric view of the headdress of FIG. 1, incorporated into a baseball cap.
Figure 6:
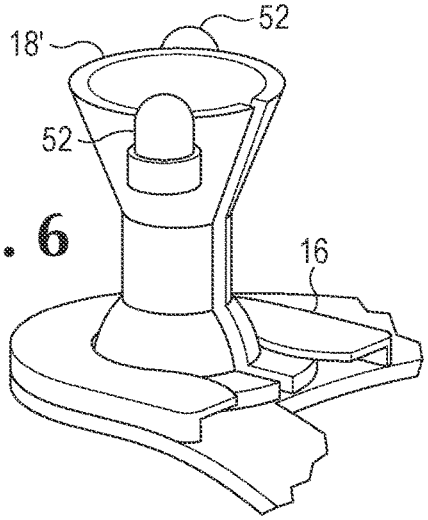
FIG. 6 is an isometric view of an illuminated balloon retaining unit
Figure 7:
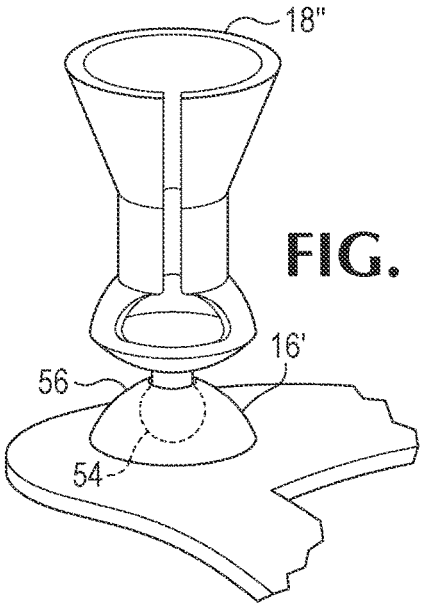
FIG. 7 is an isometric view of an alternative embodiment of a balloon retaining unit, engaged into an engagement unit.
Figure 8:
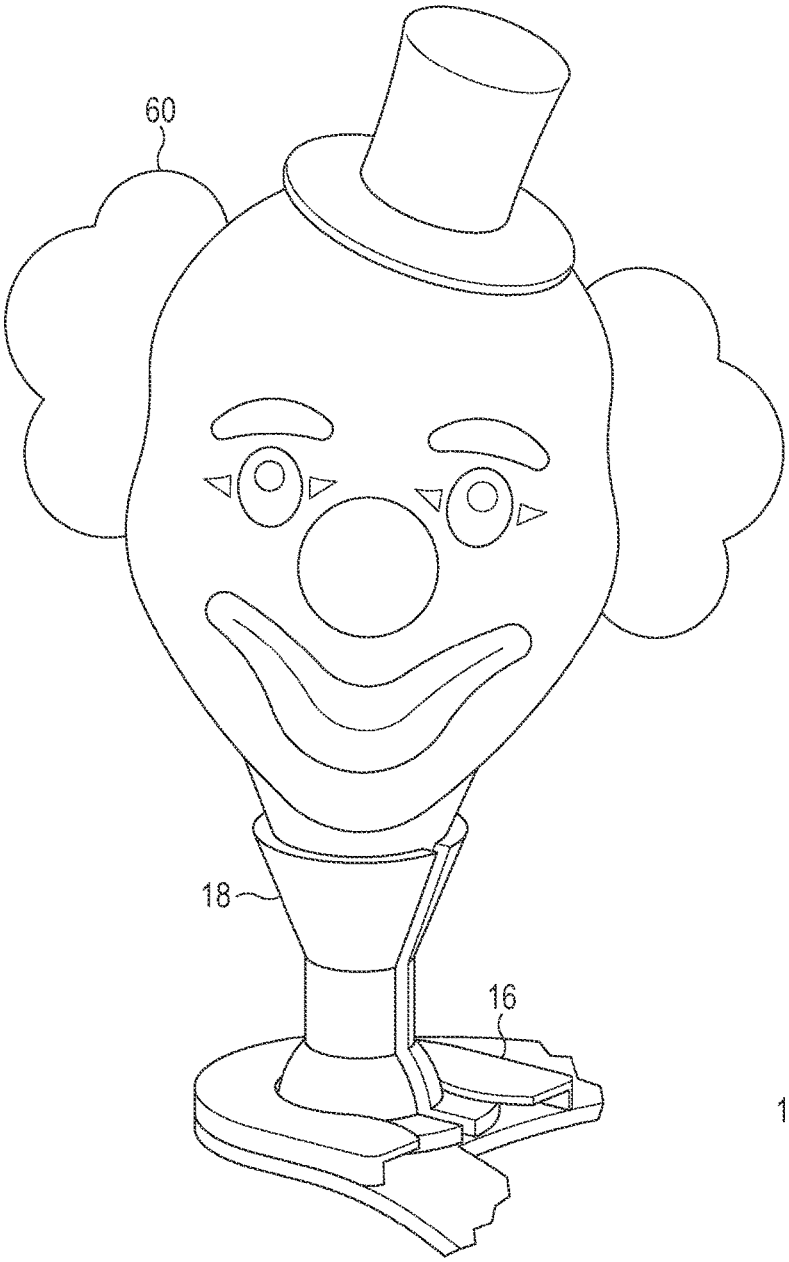
FIG. 8 is an isometric view of a clown face figurine engaged into an engagement unit.
Figure 9:
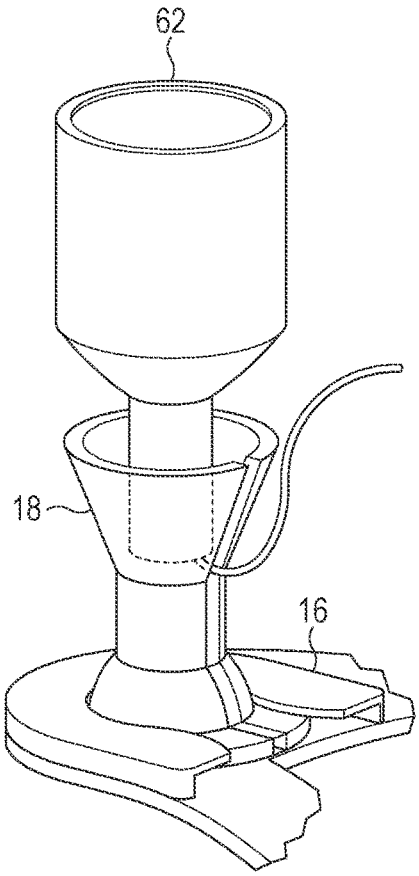
FIG. 9 is an isometric view of a confetti popper engaged into an engagement unit.

Referring to FIG. 5, in one embodiment the headdress 10 is incorporated into a baseball-cap style cap. All of the elements are the same, but the structure 12 has been sandwiched in between two pieces of fabric with the engagement units 16 extending outwardly through openings in the upper layer of fabric. Alternatively, headdress 10 can be worn over a baseball cap, with a team logo framed by the front portion of headdress 10. FIG. 6 shows an illuminated variant 18' of a retaining unit 18. A small battery (not shown) is secreted in an interior space of unit 18, with an electrical conductor connected to light emitting diodes 52. FIG. 7 shows a balloon retaining unit 18" and an engagement unit 16' that connect in a different way, with a ball 54 and a socket 56 that each have some resilient deformability, so that ball 54 will snap into socket 56 if pushed down into it, and can be pulled out, as well. FIG. 8 shows a clown face figurine 60, which in one embodiment is adapted to engage to retaining unit 18 (having a ball or knot that engages to lower cup 36 in the same manner as a balloon knot does). In another embodiment figurine 60 and retaining unit 18 are one unitary unit (that is they are sold joined together) and slide into engagement unit 16. FIG. 9 shows a confetti popper 62 engaged into a balloon retaining unit. In an alternative embodiment, the confetti popper is formed with a ball on a string, to retain it to lower cup 36.

In an alternative embodiment engagement unit and balloon retaining units are joined in some other manner, such as relying on the resilient deformability of a polymer ball, to permit it to pop into a socket.

In an alternative embodiment, one of more of the retaining units 18 are replaced with units that have a retaining flange 30 to engage with an engagement unit 16, but that have a preconfigured decorative item extending outwardly away from retaining flange 30 (and thereby the wearer's head), such as a flag-on-a-post, a figurine or confetti popping device.

The disclosed embodiments are illustrative, not restrictive. While specific configurations of the headdress have been described, it is understood that the present invention can be applied to a wide variety of display types. There are many alternative ways of implementing the invention.

What is claimed is:

1. A balloon headdress, comprising:

a) a structure sized and shaped to fit on a human head, said structure defining an inside, facing said head when worn, and an outside, opposed to said inside;

b) a plurality of engagement units, supported on said outside of said structure; and c) a number of balloon retaining units, engaged to said engagement units and adapted to receive, support and direct an inflated balloon to extend in a predetermined direction relative to each said balloon retaining unit, each said balloon retaining unit including a perimeter wall and an orthogonal septal wall, forming an upper cup and opposed lower cup, separated by said orthogonal septal wall, and wherein a vertical slot is defined in said perimeter wall and said orthogonal septal wall, whereby a tied balloon may be introduced, so that its knot is in said lower cup and a portion of said balloon passes through said slot in said orthogonal septal wall and is supported in said upper cup.

2. The balloon headdress of claim 1, wherein said balloon retaining units are slidingly engaged to said engagement units and can be disengaged by being slid out.

3. The balloon headdress of claim 1, being made of polymer.

4. The balloon headdress of claim 3, wherein said polymer is arranged in a set of strips, each strip hosting multiple engagement units.

5. The balloon headdress of claim 4, wherein said strips intersect and are joined with a set of cross-strips.

6. The balloon headdress of claim 1, having more than six engagement units.

7. The balloon headdress of claim 1, having more than eight engagement units.

8. The balloon headdress of claim 1, further including a hat, into which said structure is incorporated.

9. A method of creating a balloon-festooned headdress, comprising:

a) providing a display headdress, including:

i. a structure sized and shaped to fit on a human head, said structure defining an inside, facing said head when worn, and an outside, opposed to said inside;

ii. a plurality of engagement units, supported on said outside of said structure; and iii. a number of balloon retaining units, engaged to said engagement units and adapted to receive, support and direct an inflated balloon to extend in a predetermined direction relative to each said balloon retaining unit, each said balloon retaining unit including a perimeter wall and an orthogonal septal wall, forming an upper cup and opposed lower cup, separated by said orthogonal septal wall, and wherein a vertical slot is defined in said perimeter wall and said orthogonal septal wall, whereby a tied balloon may be introduced, so that its knot is in said lower cup and a portion of said balloon passes through said slot in said orthogonal septal wall and is supported in said upper cup; and b) inflating a balloon and tying its open end to form a knot;

c) disengaging a balloon retaining unit from an engagement unit and engaging said balloon to said balloon retaining unit by passing a portion through said vertical slot, so said knot is in said lower cup and said balloon extends out of said upper cup, and reengaging said balloon retaining unit to said engagement unit;

d) repeating steps b) and c) for additional balloons.

10. The method of claim 9, wherein said balloon retaining units are slidingly engaged to said engagement units and can be disengaged by being slid out.

11. The method of claim 9, wherein said headdress is made of polymer.

12. The method of claim 11, wherein said polymer is arranged in a set of strips, each strip hosting multiple engagement units.

13. The method of claim 12, wherein said strips intersect and are joined with a set of cross-strips.

14. The method of claim 9, wherein said display headdress has more than six engagement units.

15. The method of claim 9, wherein said display headdress has more than eight engagement units.

16. The method of claim 9, wherein said display headdress further includes a hat, into which said structure is incorporated.

* * * * *